US009904230B2

(12) United States Patent
Cavill et al.

(10) Patent No.: US 9,904,230 B2
(45) Date of Patent: Feb. 27, 2018

(54) AXIALLY SHIFTING A PHOTOCONDUCTIVE DRUM USING A CAM

(71) Applicant: LEXMARK INTERNATIONAL, INC., Lexington, KY (US)

(72) Inventors: Gregory Alan Cavill, Winchester, KY (US); Christopher Hayden Noffsinger, Lexington, KY (US); Daniel Lee Thomas, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/168,759

(22) Filed: May 31, 2016

(65) Prior Publication Data

US 2017/0343950 A1 Nov. 30, 2017

(51) Int. Cl.
*G03G 15/00* (2006.01)

(52) U.S. Cl.
CPC ..... *G03G 15/751* (2013.01)

(58) Field of Classification Search
CPC ..... G03G 21/1671; G03G 21/1839; G03G 21/1842; G03G 21/185; G03G 21/1853; G03G 15/751
USPC ..... 399/117
See application file for complete search history.

(56) References Cited

U.S. PATENT DOCUMENTS

| | | | | |
|---|---|---|---|---|
| 4,425,036 | A | 1/1984 | Kameyama et al. | |
| 4,833,502 | A * | 5/1989 | Azuma | G03G 15/757 347/264 |
| 5,371,576 | A * | 12/1994 | Gonda | G03G 15/751 399/167 |
| 6,226,478 | B1 | 5/2001 | Watanabe et al. | |
| 7,840,162 | B2 * | 11/2010 | Suzuki | G03G 15/757 399/167 |
| 2012/0163866 | A1 | 6/2012 | Morishita | |
| 2016/0216688 | A1 * | 7/2016 | Katayama | G03G 21/1821 |
| 2016/0252868 | A1 | 9/2016 | Morishita et al. | |

FOREIGN PATENT DOCUMENTS

| | | |
|---|---|---|
| JP | 2006-267952 A | 10/2006 |
| JP | 2015-227953 A | 12/2015 |

OTHER PUBLICATIONS

U.S. Appl. No. 15/168,726, filed May 31, 2016 (Cavill et al.).
U.S. Appl. No. 15/168,779, filed May 31, 2016 (Gist et al.).

* cited by examiner

*Primary Examiner* — Billy Lactaoen

(57) ABSTRACT

A photoconductor unit for an electrophotographic image forming device according to one example embodiment includes a housing and a photoconductive drum rotatably mounted on the housing. A cam is mounted on the housing and has a cam surface that is positioned to contact a corresponding locating surface. The cam surface has a variable height in an axial direction of the photoconductive drum such that as a position of the cam changes relative to the housing, the photoconductive drum shifts in the axial direction relative to the locating surface.

15 Claims, 16 Drawing Sheets

AXIALLY SHIFTING A PHOTOCONDUCTIVE DRUM USING A CAM

CROSS REFERENCES TO RELATED APPLICATIONS

None.

BACKGROUND

1. Field of the Disclosure

The present disclosure relates generally to electrophotographic imaging devices and more particularly to axially shifting a photoconductive drum using a cam.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the photoconductive drum. The toned image is transferred to the print media (e.g., paper) directly by the photoconductive drum in a direct contact imaging system. The toner is then fused to the media using heat and pressure to complete the print.

Repeated contact with the media sheets causes wear on the surface of the photoconductive drum, particularly where the edges of the media sheets contact the surface of the photoconductive drum. Excessive wear on the surface of the photoconductive drum may limit the useful life of the photoconductive drum and cause print defects. Accordingly, it is desired to reduce the occurrence of wear on the surface of the photoconductive drum in order extend the useful life of the photoconductive drum.

SUMMARY

A photoconductor unit for an electrophotographic image forming device according to one example embodiment includes a housing and a photoconductive drum rotatably mounted on the housing. A cam is mounted on the housing and has a cam surface that is positioned to contact a corresponding locating surface. The cam surface has a variable height in an axial direction of the photoconductive drum such that as a position of the cam changes relative to the housing, the photoconductive drum shifts in the axial direction relative to the locating surface.

A photoconductor unit for an electrophotographic image forming device according to another example embodiment includes a housing and a photoconductive drum rotatably mounted on the housing. A cam is mounted on the housing coaxial with the photoconductive drum and rotatable independent of the photoconductive drum. The cam and the photoconductive drum have a fixed relationship to one another in an axial direction of the photoconductive drum. The cam has a cam surface on an axial end of the cam that is positioned to contact a locating surface. The cam surface has a variable height in the axial direction of the photoconductive drum such that as a rotational position of the cam changes relative to the housing, the cam and the photoconductive drum shift in the axial direction of the photoconductive drum relative to the locating surface.

An image transfer assembly of an electrophotographic image forming device according to one example embodiment includes a photoconductive drum rotatable about an axis of rotation within the image forming device. A cam is connected to the photoconductive drum and rotatable independent of the photoconductive drum. The cam has a cam surface that has a variable height in an axial direction of the photoconductive drum. A locating surface is in contact with the cam surface. As a rotational position of the cam changes relative to the locating surface, the cam shifts in the axial direction of the photoconductive drum relative to the locating surface causing the photoconductive drum to shift in the axial direction relative to the locating surface.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
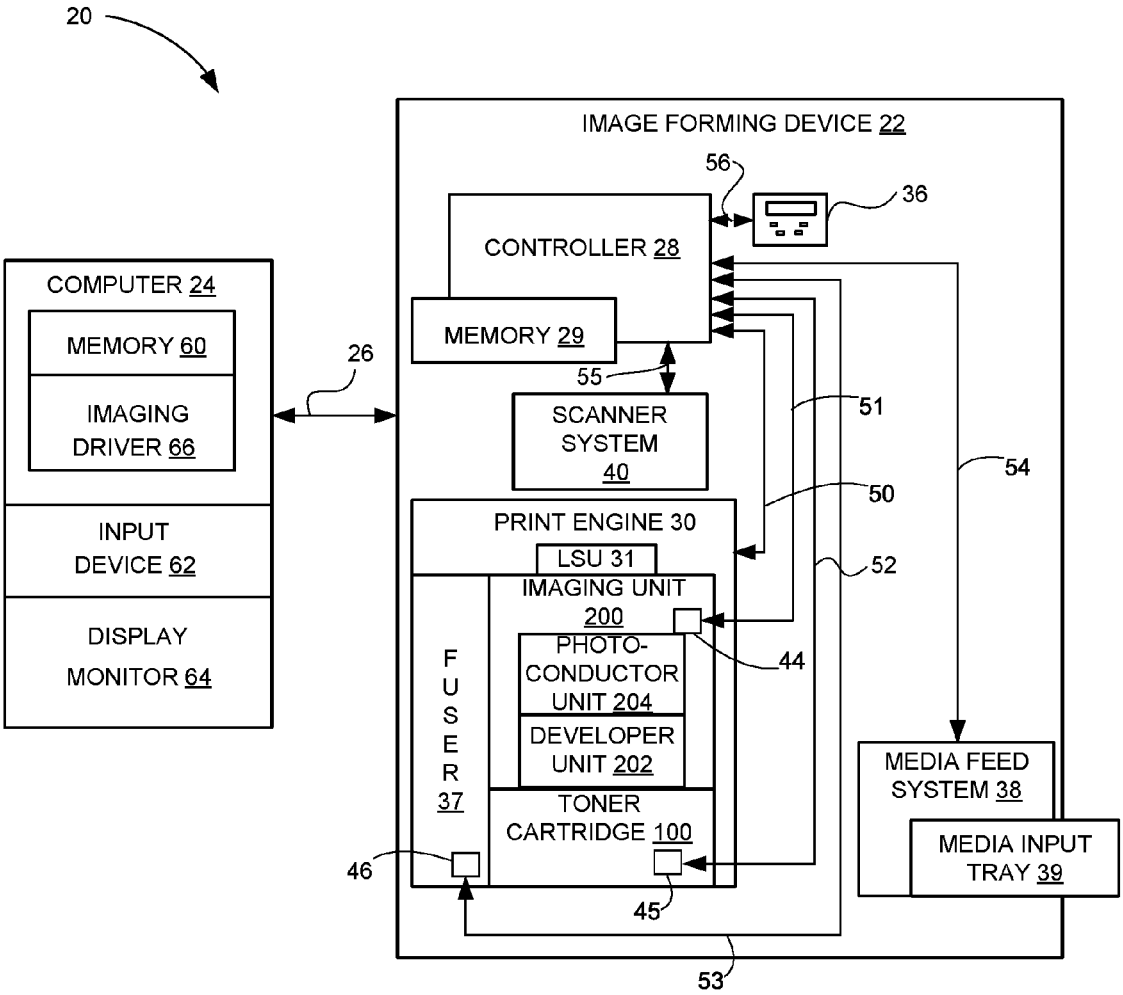
FIG. 1 is a block diagram depiction of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 202 includes a magnetic roll that attracts the magnetic carrier beads having toner thereon to the magnetic roll through the use of magnetic fields. Imaging unit 200 also includes a photoconductor unit 204 that houses a photoconductive drum and a waste toner removal system.

Toner cartridge 100 is removably mounted in image forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 202.

The electrophotographic printing process is well known in the art and, therefore, is described briefly herein. During a printing operation, laser scan unit 31 creates a latent image on the photoconductive drum in photoconductor unit 204. Toner is transferred from the toner sump in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. In one example embodiment, toner is transferred directly to the media sheet by the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
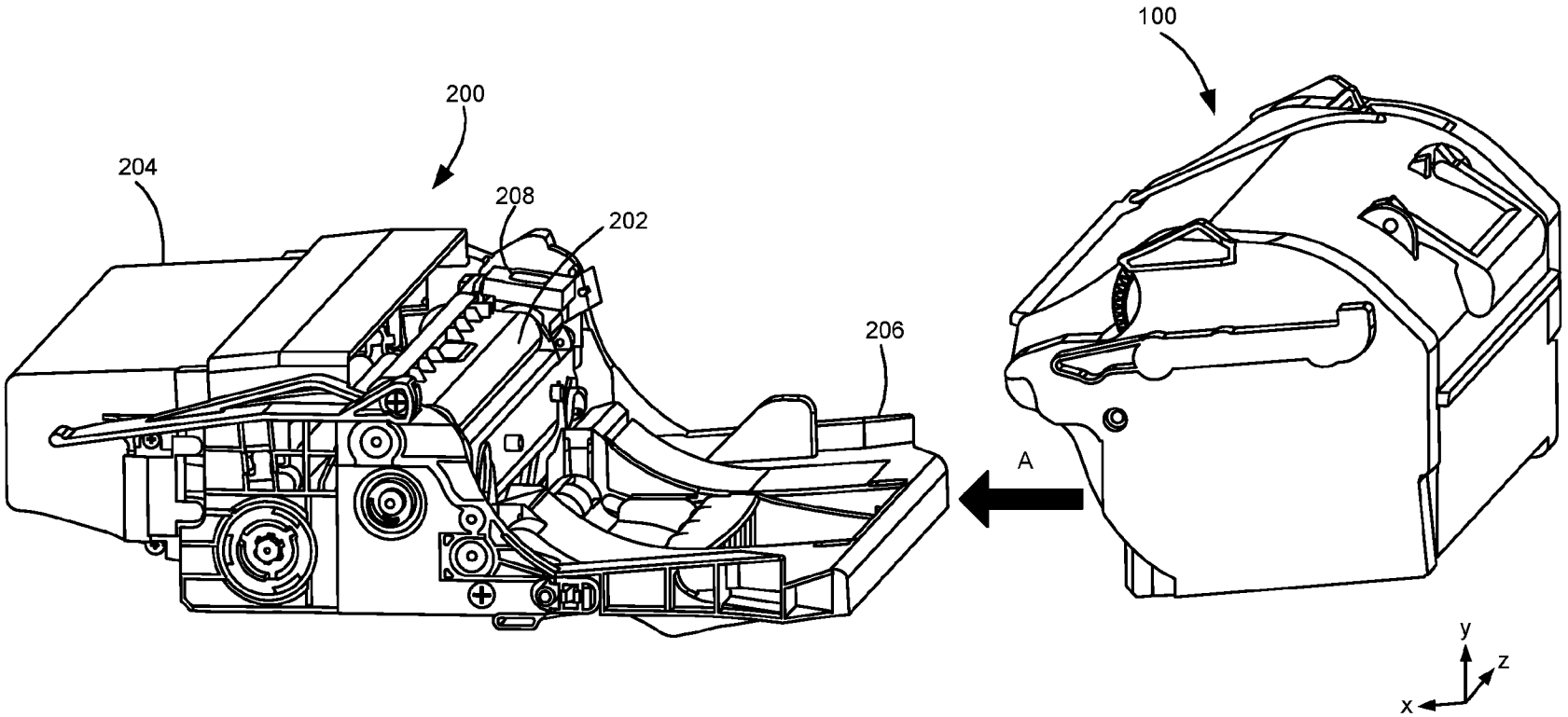
FIG. 2 is a perspective view of a toner cartridge and an imaging unit of an image forming device according to one example embodiment.

Referring now to FIG. 2, toner cartridge 100 and imaging unit 200 are shown according to one example embodiment. Imaging unit 200 includes developer unit 202 and photoconductor unit 204 mounted on a common frame or housing 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto housing 206 in a mating relationship with developer unit 202 of imaging unit 200 as indicated by the arrow A shown in FIG. 2, which also indicates the direction of insertion of imaging unit 200 and toner cartridge 100 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, photoconductor unit 204 or housing 206 or to clear a media jam.

While the example embodiment shown in FIG. 2 illustrates a single toner cartridge 100 and corresponding imaging unit 200, it will be appreciated that a multicolor image forming device 22 may include multiple toner cartridges 100 and corresponding imaging units ix) 200. Further, although in the example embodiment shown in FIG. 2 toner is transferred directly from toner cartridge 100 to imaging unit 200, toner may alternatively pass through an intermediate component such as a chute or duct that connects toner cartridge 100 with its corresponding imaging unit 200.

The configurations and architecture of toner cartridge 100 and imaging units 200 shown in FIG. 2 are meant to serve as examples and are not intended to be limiting. For instance, although the example image forming devices discussed above include a pair of mating replaceable units in the form of toner cartridge 100 and imaging unit 200, it will be appreciated that the replaceable unit(s) of the image forming device may employ any suitable configuration as desired. For example, in one embodiment, the main toner supply for image forming device 22 and the components of imaging unit 200 are housed in a single replaceable unit. In another embodiment, the main toner supply for image forming device 22 and developer unit 202 are provided in a first replaceable unit and photoconductor unit 204 is provided in a second replaceable unit. In another embodiment, the main toner supply for image forming device 22 is provided in a first replaceable unit, developer unit 202 is provided in a second replaceable unit and photoconductor unit 204 is provided in a third replaceable unit. One skilled in the art will appreciate that many other combinations and configurations of toner cartridge 100 and imaging unit 200 may be used as desired.

Figure 3:
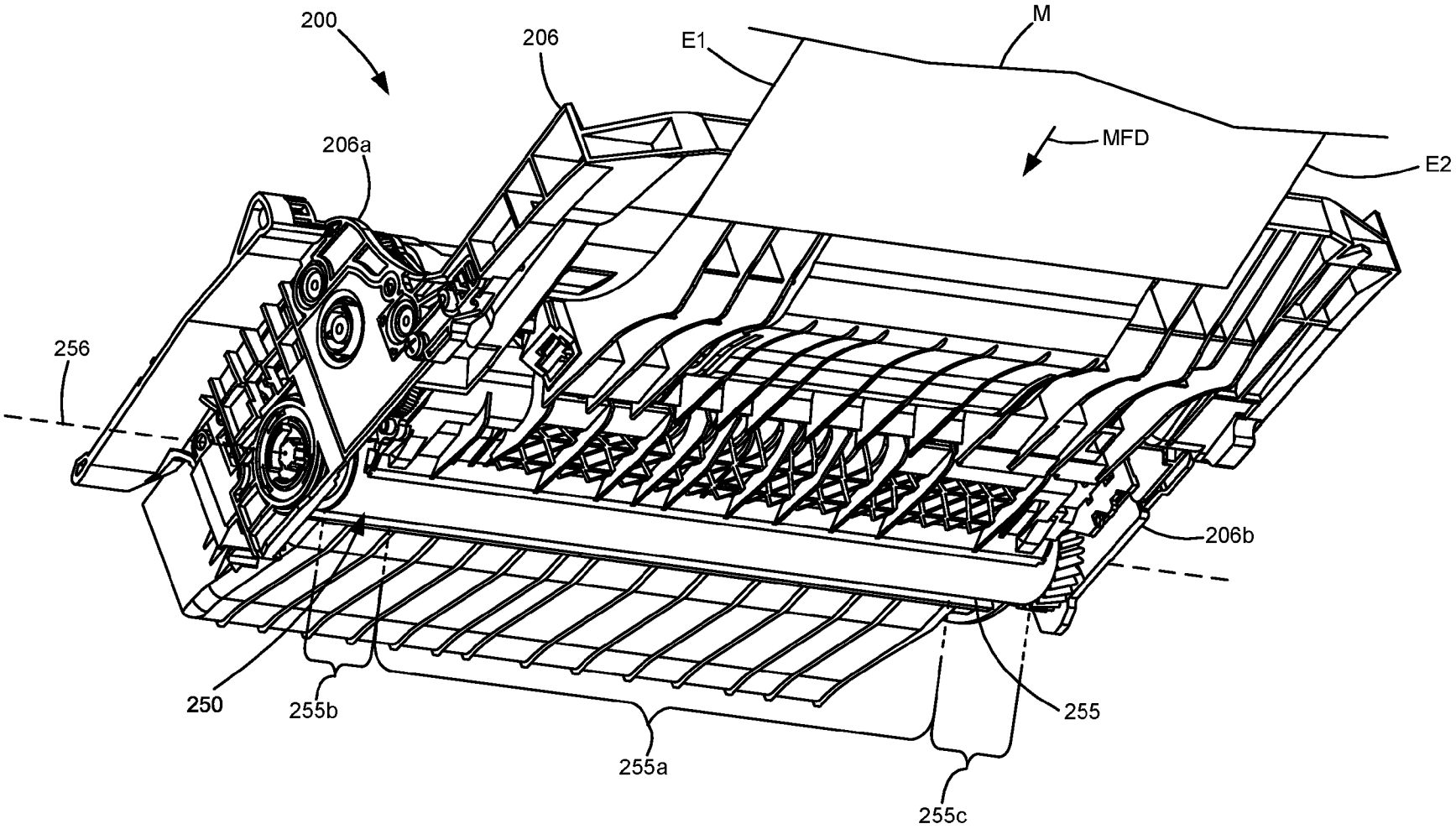
FIG. 3 is a bottom perspective view of the imaging unit showing a photoconductive drum assembly according to one example embodiment.
Figure 4:
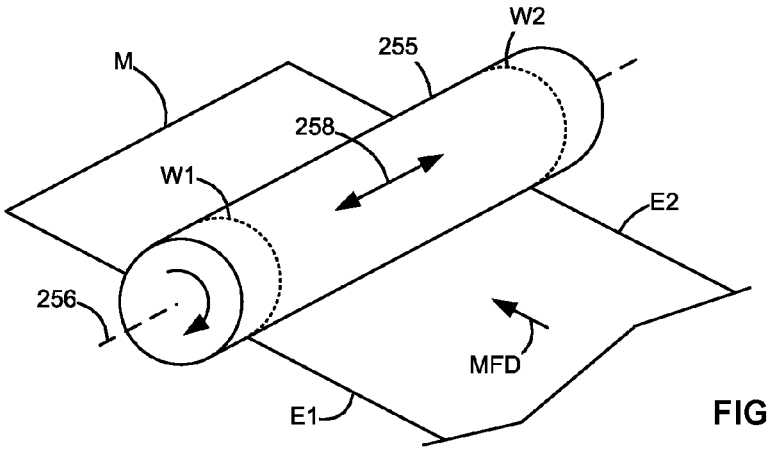
FIG. 4 is a schematic illustration of a media sheet being fed past and contacting the photoconductive drum.

With reference to FIG. 3, imaging unit 200 is shown including a photoconductive drum assembly 250 including a photoconductive drum 255 rotatably mounted on housing 206 between opposed side walls 206*a*, 206*b* about an axis of rotation 256. When imaging unit 200 is inserted into image forming device 22, photoconductive drum 255 is paired with a transfer roll (not shown) forming a toner transfer nip therebetween for use in transferring toner to a sheet of print media passing through the transfer nip. In the example shown, a media sheet M is fed in a media feed direction MFD and passes through the toner transfer nip to receive toner from the surface of photoconductive drum 255. Photoconductive drum 255 has an axial length including an imaging region 255*a* at a central portion thereof and non-imaging regions 255*b*, 255*c* at end portions thereof. Media sheet M contacts the imaging region 255*a* of photoconductive drum 255 as media sheet M passes through the toner transfer nip. The physical roughness of media sheet M may wear the surface of photoconductive drum 255 throughout the imaging region 255*a* contacted by media sheet M. The areas where the edges E1, E2 of media sheet M contact photoconductive drum 255 typically cause significantly more wear on the surface of photoconductive drum 255 than the area of imaging region 255*a* between edges E1, E2. In particular, as photoconductive drum 255 rotates, media sheet edges E1, E2 may create relatively deep scratches or form wear rings on the surface coating of photoconductive drum 255 over time that may extend around its entire circumference. For example, in FIG. 4 showing a simplified illustration of media sheet M being fed in the media feed direction MFD and contacting photoconductive drum 255, wear marks W1, W2 are formed on opposed end regions of the surface of photoconductive drum 255 due to repeated contact between the surface of photoconductive drum 255 and edges of media sheets being fed through the transfer nip, such as edges E1, E2 of media sheet M.

According to example embodiments of the present disclosure, the additional wear in the regions where edges of the media sheet contact photoconductive drum 255 may be reduced by shifting photoconductive drum 255 axially, perpendicular to the media feed direction MFD. In particular, a shifting mechanism is provided to translate an operating position of photoconductive drum 255 within image forming device 22 axially relative to its axis of rotation 256. By axially moving photoconductive drum 255, wear on the surface of photoconductive drum 255 caused by the edges of the media sheet is spread out over a relatively wider area at each end of photoconductive drum 255 instead of being concentrated at a single location at each end of photoconductive drum 255. Spreading the wear incurred on the surface of photoconductive drum 255 aids in extending the useful life of photoconductive drum 255.

Figure 5A:
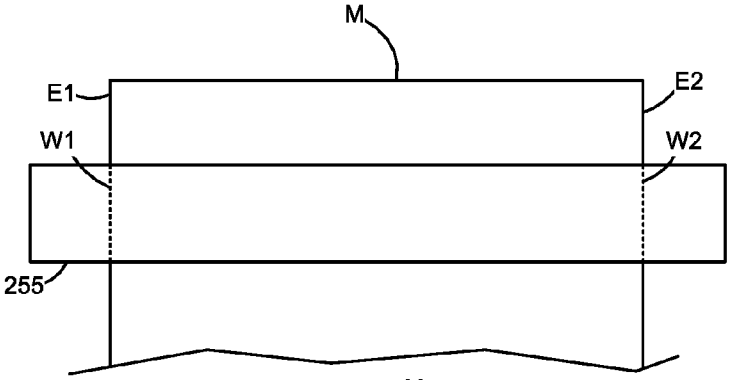
FIGS. 5A-5C are schematic illustrations of axial movement of the photoconductive drum according to one example embodiment.
Figure 5B:
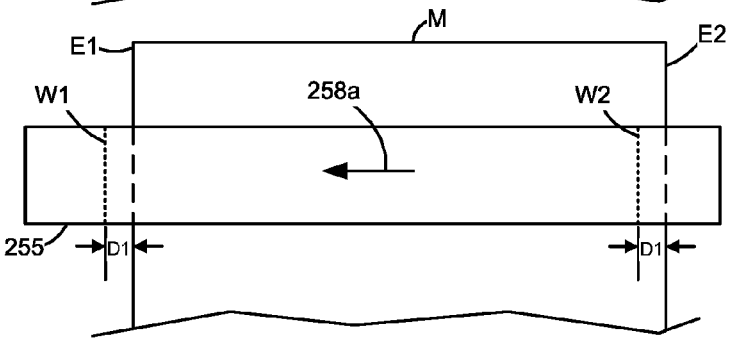
Figure 5C:
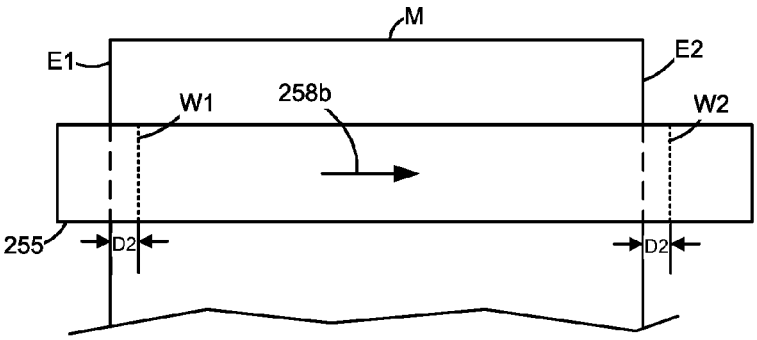

As an example, FIGS. 5A-5C illustrate schematic representations of photoconductive drum 255 movable along its rotational axis 256, perpendicular to media feed direction MFD, and media sheet M passing through photoconductive drum 255. Media sheet M is provided to illustrate the location of media sheet edges relative to the surface of photoconductive drum 255 as media sheets are fed through the toner transfer nip. In FIG. 5A, photoconductive drum 255 is at an initial position in image forming device 22 with initial edge wear boundaries W1, W2 corresponding to the location of edges E1, E2 of media sheet M. In order to substantially reduce wear at the initial edge wear boundaries W1, W2, photoconductive drum 255 is axially shifted, perpendicular to the media feed direction MFD, such as shown in FIGS. 5B and 5C. In FIG. 5B, photoconductive drum 255 is axially shifted in a first direction 258*a* such that edge wear boundaries W1, W2 are shifted laterally from respective edges E1, E2 of media sheet M by a distance D1. In FIG. 5C, photoconductive drum 255 is axially shifted in a second direction 258*b* such that media sheet edges E1, E2 are spaced apart from the initial edge wear boundaries W1, W2 by a distance D2. By axially moving photoconductive drum 255 between the positions shown in FIGS. 5B and 5C, location of the media sheet edges relative to the surface of photoconductive drum 255 are shifted such that the media sheet edges do not contact and apply stress concentration on the same respective regions of the photoconductive drum surface as media sheets pass through the toner transfer nip. Instead, wear is spread out over a wider area, such the areas defined by distances D1 and D2, which extends the useful life of photoconductive drum 255. In one example embodiment, photoconductive drum 255 is moved gradually between the positions shown in FIGS. 5B and 5C. In another example embodiment, photoconductive drum 255 is moved between the positions illustrated in FIGS. 5B and 5C and discrete positions intermediate those illustrated in FIGS. 5B and 5C.

Figure 6:
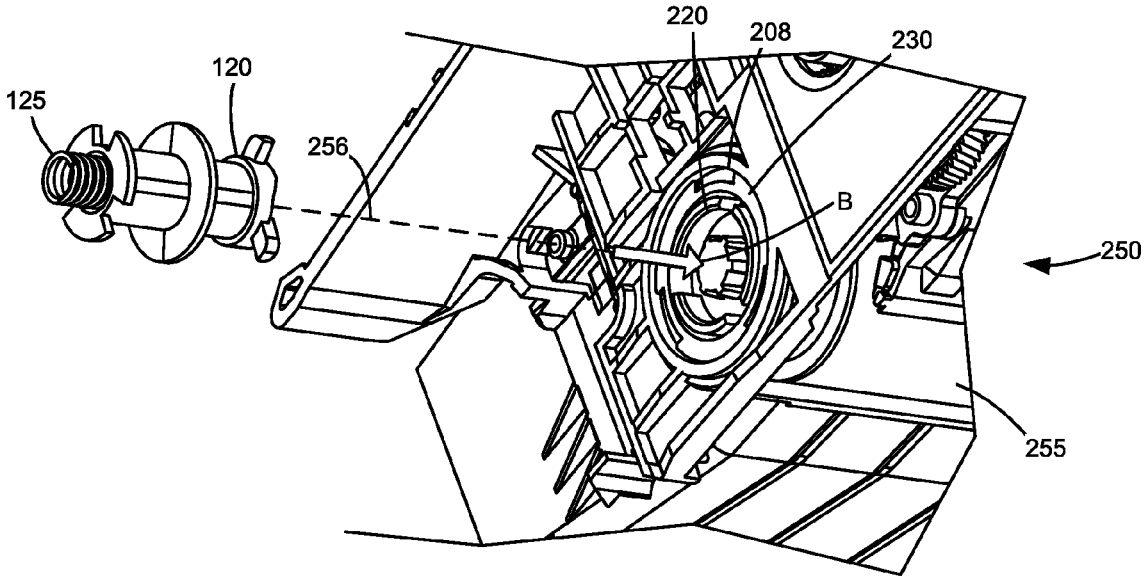
FIG. 6 is a perspective view of a portion of the imaging unit showing a drive coupler of the photoconductive drum and a corresponding drive coupler of the image forming device according to one example embodiment.

Referring now to FIG. 6, photoconductive drum assembly 250 includes a drive coupler 220 that is positioned to mate with a corresponding drive coupler 120 in image forming device 22. When imaging unit 200 is installed in image forming device 22, drive coupler 220 is engaged with drive coupler 120 and receives rotational and axial force therefrom for rotating and axially biasing photoconductive drum 255 in a direction indicated by the arrow B shown in FIG. 6, which is also perpendicular to the media feed direction MFD. Drive coupler 120 is biased toward drive coupler 220 in order to ensure reliable contact between the two to permit the transfer of rotational force from drive coupler 120 to drive coupler 220. For example, in the embodiment illustrated, a biasing spring 125 biases drive coupler 120 toward drive coupler 220. The bias applied to drive coupler 120 presses drive coupler 120 axially against the axial end surface of drive coupler 220 in order to maintain contact between drive coupler 120 and drive coupler 220.

Figure 7:
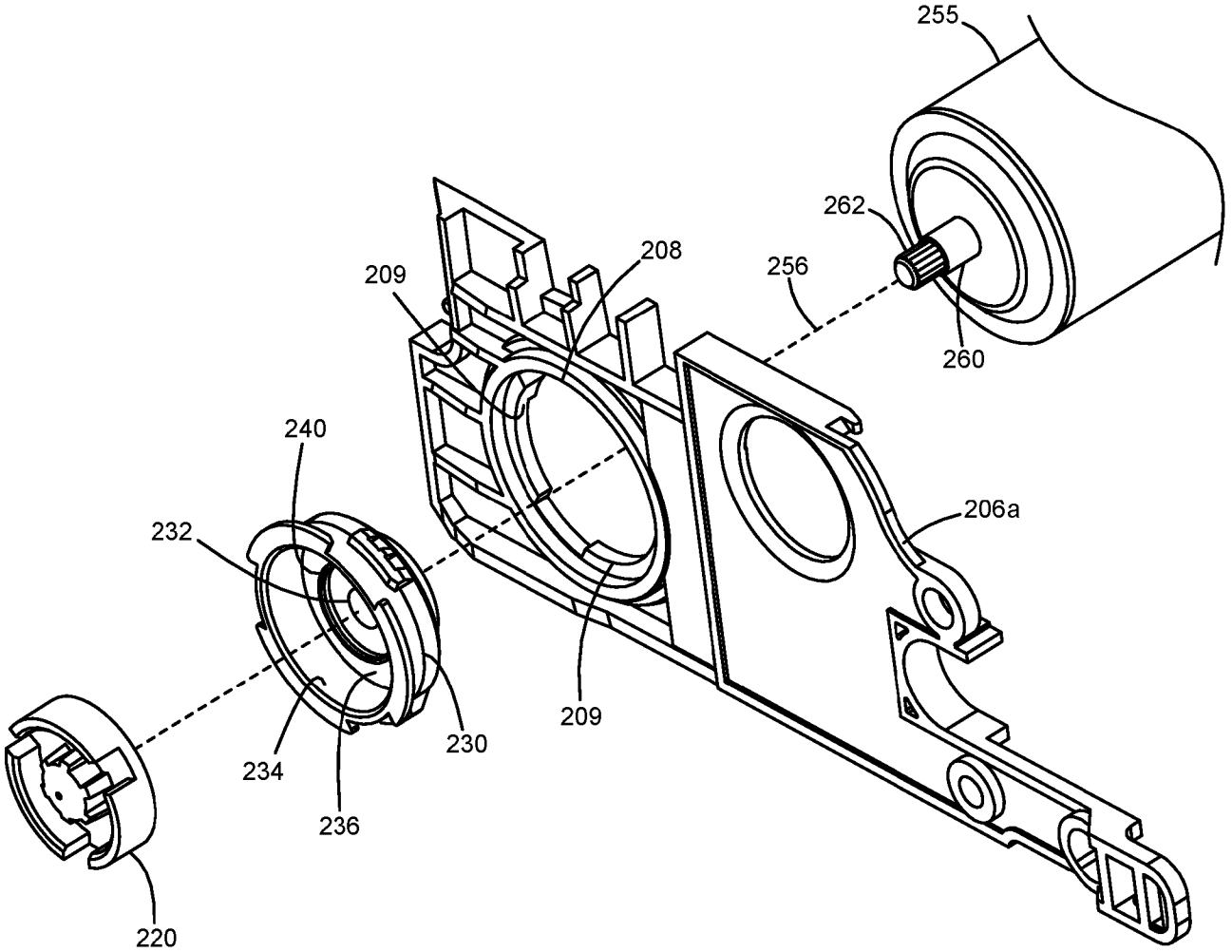
FIG. 7 is an exploded view of the imaging unit shown in FIG. 6 showing a wear member according to one example embodiment.

FIG. 7 illustrates an exploded view of an end portion of photoconductive drum 255. As shown, side wall 206*a* of housing 206 includes an opening 208. Provided in opening 208 is a bushing 230 which is fixedly mounted on side wall 206*a* and arranged to receive and rotatably support a shaft end 260 of photoconductive drum 255 via an opening 232. Side wall 206*a* includes retainers 209 which secure bushing 230 on side wall 206*a*. Drive coupler 220 is mounted on shaft end 260 extending through opening 232 and rests within a socket 234 of bushing 230. Splines 262 are provided on shaft end 260 to seat drive coupler 220 onto shaft end 260 and cause photoconductive drum 255 to rotate when drive coupler 220 is driven to rotate.

In one example embodiment shown, a raised wear surface or member 240 is provided between drive coupler 220 and bushing 230. In the example shown, raised wear member 240 is provided as a wear ring integrally formed as part of bushing 230 and protrudes from an inner surface 236 of socket 234. Raised wear member 240 is positioned to receive frictional contact from drive coupler 220 in the axial bias direction B. Raised wear member 240, although shown as having an annular shape surrounding shaft end 260, may have other forms or shapes, such as, for example, one or more posts or pegs. As drive coupler 220 and photoconductive drum 255 rotate, bushing 230 including raised wear member 240 remains stationary relative to housing 206 and the frictional contact between drive coupler 220 and raised wear member 240 gradually wears away raised wear member 240 in the axial bias direction B. The wearing away of wear member 240 in the axial bias direction B gradually shifts the position of photoconductive drum 255 axially in the axial bias direction B relative to housing 206, which occupies a fixed position in image forming device 22. In this embodiment, wear member 240 is made of softer material than drive coupler 220 such that drive coupler 220 wears at a much slower rate, or not at all, relative to wear member 240.

Figure 8A:
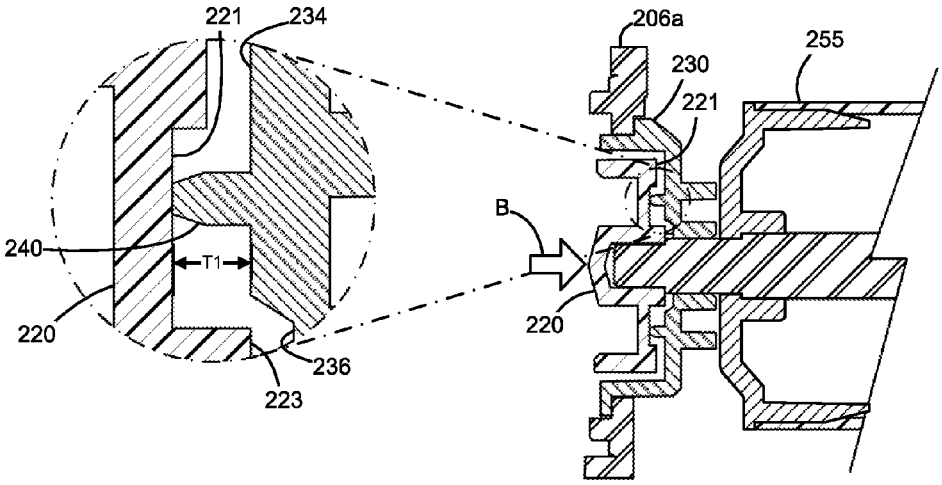
FIGS. 8A-8C are cross-sectional views illustrating axial shifting of the photoconductive drum shown in FIGS. 6 and 7 due to frictional contact between the wear member and the drive coupler of the photoconductive drum according to one example embodiment.
Figure 8B:
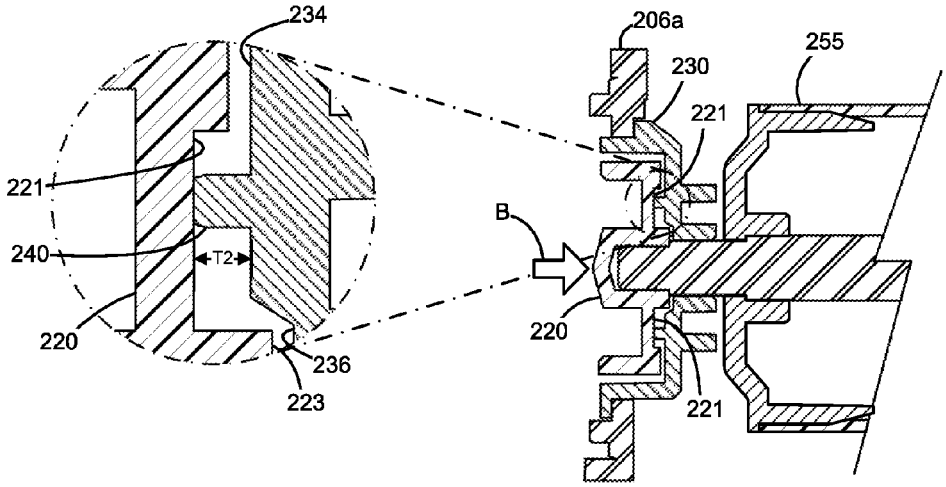
Figure 8C:
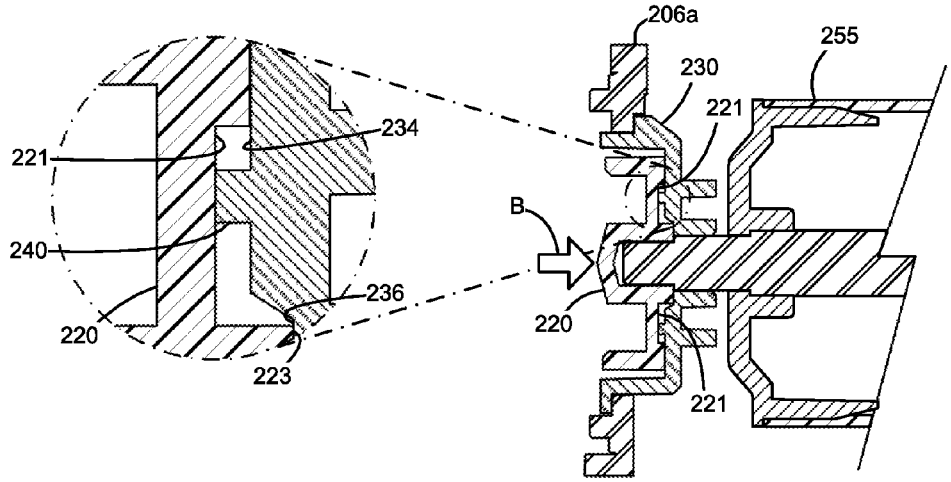

With reference to FIGS. 8A-8C, axial shifting of photoconductive drum 255 due to frictional contact between raised wear member 240 and drive coupler 220 is shown according to one example embodiment. Photoconductive drum 255 is axially movable between an initial axial position (shown in FIG. 8A) and a final axial position (shown in FIG. 8C), perpendicular to the media feed direction MFD. The initial axial position corresponds to a position of photoconductive drum 255 prior to the first use thereof and the final axial position corresponds to a position at which photoconductive drum 255 stops and no longer moves axially after photoconductive drum 255 has been used in image forming device 22 for some time. In FIG. 8A, photoconductive drum 255 is at its initial axial position relative to housing 206 with raised wear member 240 having an initial thickness T1 in the axial direction and engaging a first contact surface 221 of drive coupler 220. As shown, first contact surface 221 of drive coupler 220 is spaced from inner surface 234 by a gap defined by thickness T1. As drive coupler 220 is axially biased against raised wear member 240 in the bias direction B when drive coupler 220 receives rotational and axial force from drive coupler 120, frictional engagement between raised wear member 240 and drive coupler 220 wears away raised wear member 240 and gradually reduces the thickness T of wear member 240. In FIG. 8B, the thickness of raised wear member 240 has been reduced to an intermediate thickness T2. With the axial thickness T of raised wear member 240 being reduced and drive coupler 220 receiving continued axial bias from drive coupler 120, drive coupler 220 is pushed closer to bushing 230 in the axial bias direction B. Since drive coupler 220 is coupled to shaft end 260 of photoconductive drum 255, the shift in axial position of drive coupler 220 pushes photoconductive drum 255 in the axial bias direction B thereby shifting the axial position of photoconductive drum 255 relative to housing 206. The wear rate of wear member 240 and, in turn, the rate of shifting of photoconductive drum 255 may vary based on the material selection of wear member 240, the axial load applied to drive coupler 220 and the speed at which photoconductive drum 255 is rotated during operation.

In one example embodiment, bushing 230 includes a stop 236 that locates drive coupler 220 in its final position shown in FIG. 8C. That is, when raised wear member 240 has worn to an extent that a second contact surface 223 of drive coupler 220 contacts stop 236, stop 236 blocks drive coupler 220, and consequently photoconductive drum 255, from axially moving further in the bias direction B. The depth of stop 236 in the axial direction may be selected such that photoconductive drum 255 does not move beyond the operating window for the imaging process. In one example embodiment, photoconductive drum 255 is shifted axially about 1-2 mm from its initial position to its final position.

Figure 9:
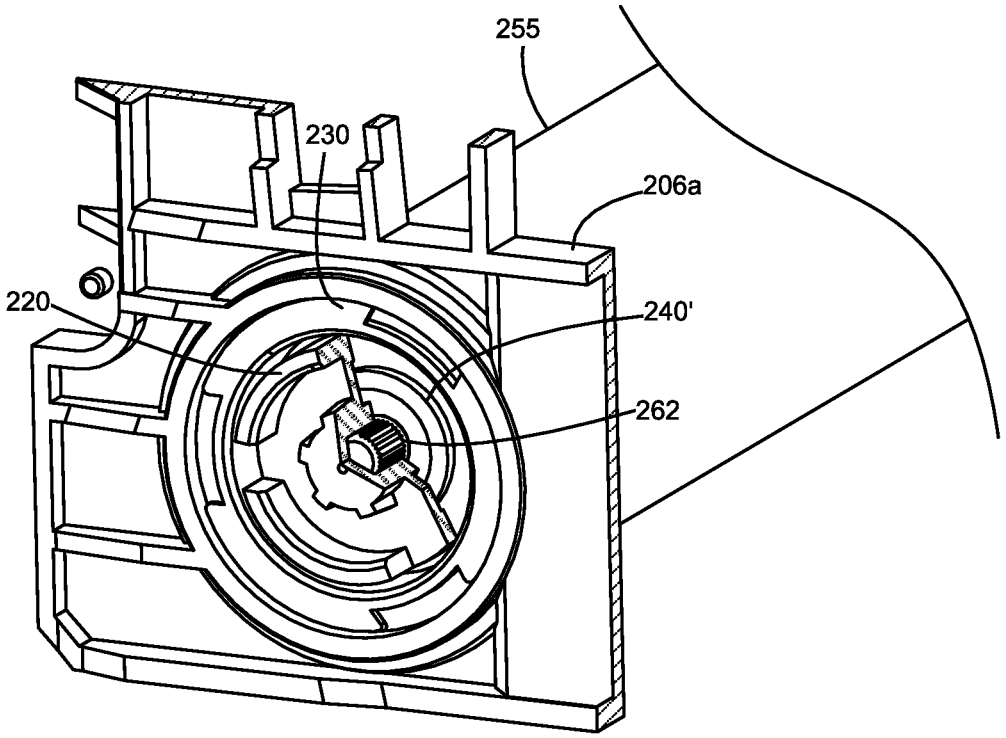
FIG. 9 is a perspective view of the imaging unit having a portion of the drive coupler removed to illustrate a wear member according to another example embodiment.
Figure 10:
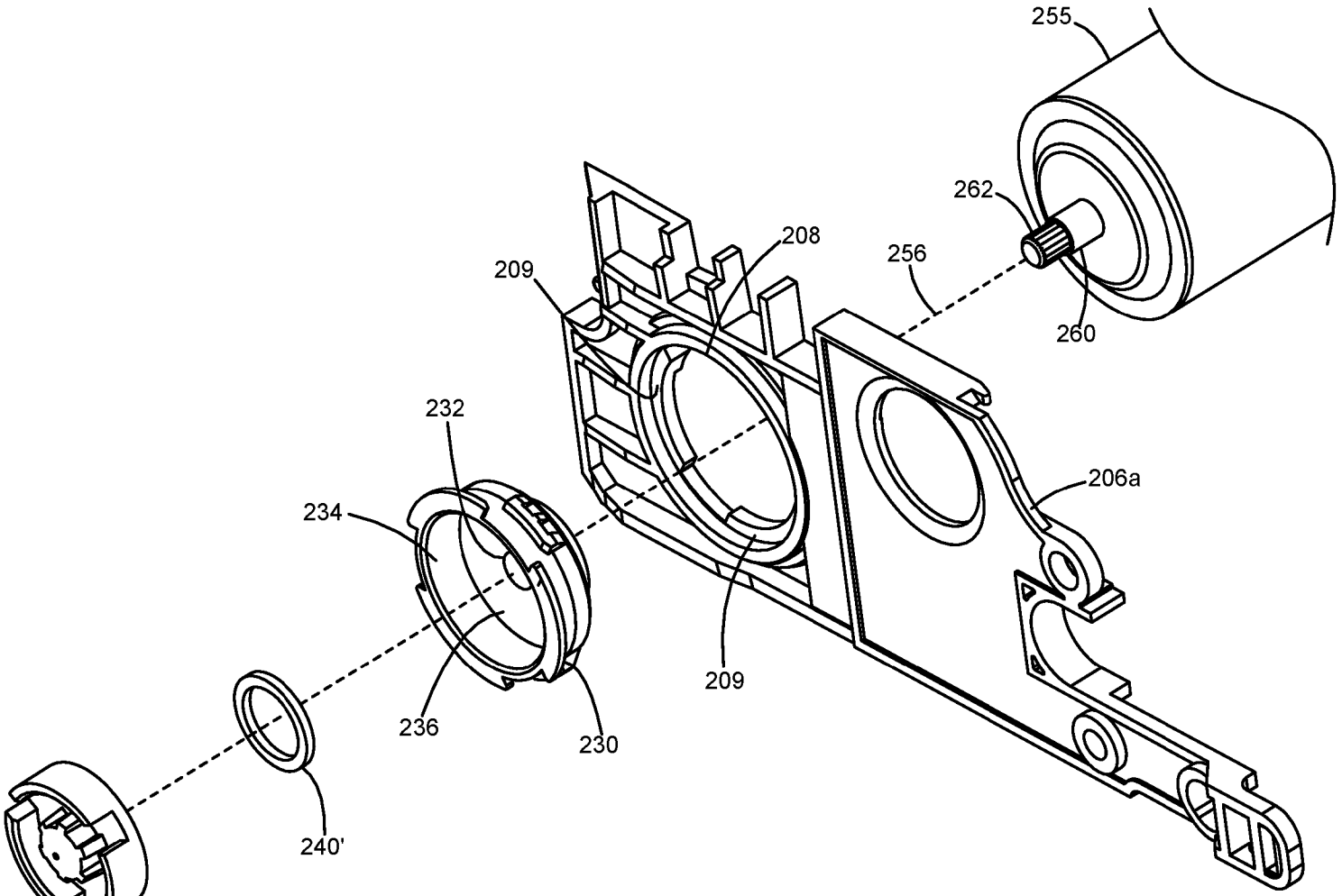
FIG. 10 is an exploded view of the imaging unit shown in FIG. 9.

In one alternative example embodiment, the wear member may be provided as a separate component that is positioned between bushing 230 and drive coupler 220. For example, FIGS. 9-10 show a dedicated spacer or washer 240' disposed between bushing 230 and drive coupler 220 that serves as the wear member. As with raised wear member 240, washer 240' is positioned to receive frictional contact from drive coupler 220 in the axial bias direction B on photoconductive drum 255 such that as photoconductive drum 255 rotates, frictional contact on washer 240' gradually wears away washer 240' in the axial bias direction B resulting in the gradual shifting of photoconductive drum 255 in the axial bias direction B. When washer 240' has worn beyond a predetermined point, the second contact surface 223 of drive coupler 220 contacts stop 236 of bushing 230 thereby limiting further axial movement of drive coupler 220 and consequently photoconductive drum 255.

The above example embodiments show a wear surface or member positioned between bushing 230 and drive coupler 220. However, it will be appreciated that a wear member may be provided elsewhere in photoconductive drum assembly 250. Further, although the example embodiments include a wear member in frictional contact with drive coupler 220, the wear member may be in frictional contact with other components of photoconductive drum assembly 250 (e.g., with photoconductive drum 255). For example, a wear member may instead be positioned at an axial end of photoconductive drum 255 opposite shaft end 260 thereof. Alternatively, a wear member may be formed as part of or attached to drive coupler 220 and biased against bushing 230.

The wear member may be composed of any suitable material based on the desired wear rate. Example materials include graphite, polytetrafluoroethylene (e.g., Teflon™ sold by Chemours™), thermoplastic elastomers such as polyester (e.g., Hytrel® sold by DuPont™) Preferably, the wear member has a low coefficient of friction and a consistent, predictable wear rate. It is also preferred that debris generated by the wearing away of the wear member does not contaminate or damage the electrophotographic components of image forming device 22.

The configurations for axially moving the position of photoconductive drum 255 are not limited to the example embodiments illustrated. Other configurations may be implemented as desired. For example, image forming device 22 may include features that shift or vary the position of imaging unit 200 relative to image forming device 22 along axis of rotation 256 or that shift or vary the position of photoconductive drum 255 relative to housing 206 along axis of rotation 256.

Figure 11:
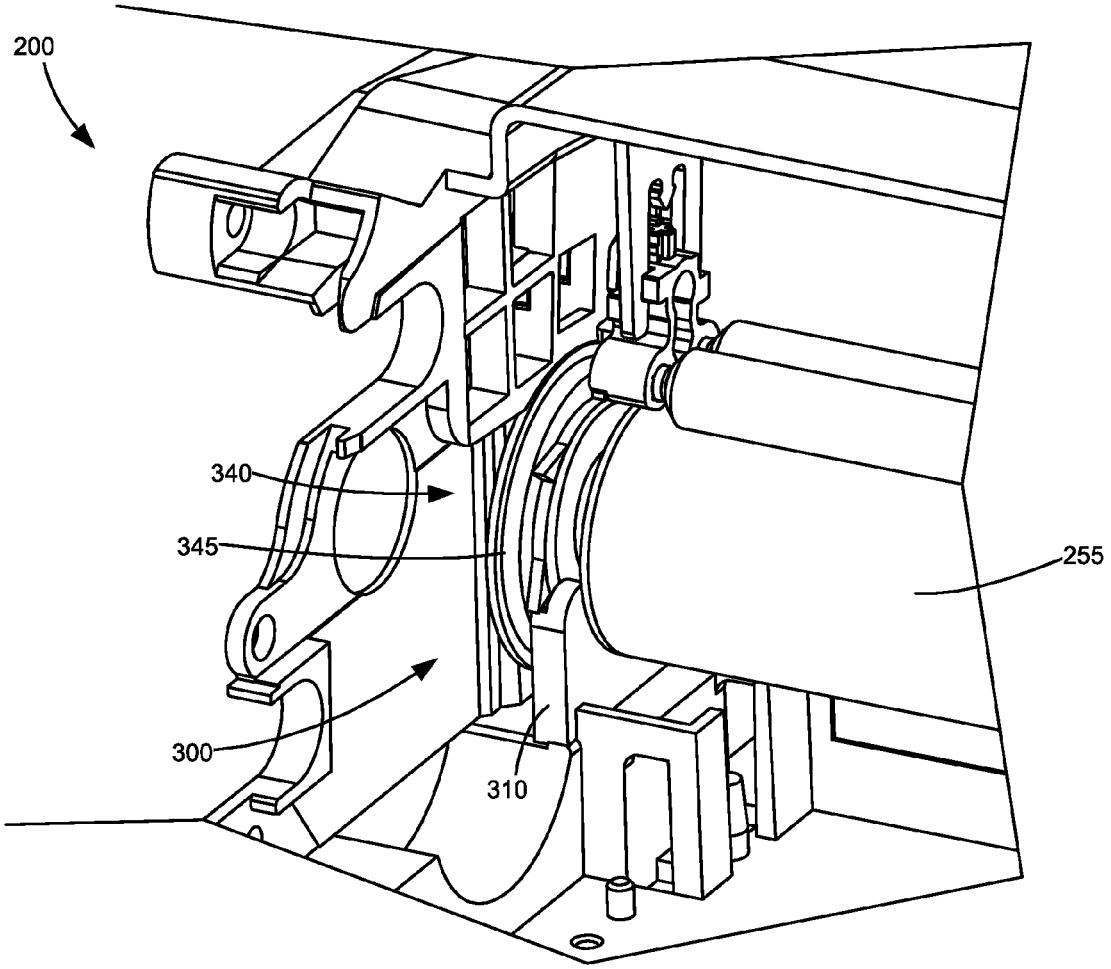
FIG. 11 is a perspective view of the imaging unit showing a ratchet mechanism according to one example embodiment.

With reference to FIG. 11, there is shown an adjustment mechanism 300 for periodically shifting the position of imaging unit 200 within image forming device 22 along axis of rotation 256, perpendicular to the media feed direction MFD, according to one example embodiment. Adjustment mechanism 300 includes a datum member 310 provided within an interior of image forming device 22 and a ratchet mechanism 340 provided in imaging unit 200. In the example shown, datum member 310 is integrated within a housing of image forming device 22 and ratchet mechanism 340 is rotatably mounted on imaging unit 200 adjacent to bushing 230 and positioned to engage datum member 310 when imaging unit 200 is installed in image forming device 22. In this example embodiment, ratchet mechanism 340 operates as a rotating mechanism that includes a cam 345 having a cam surface 347 (FIG. 12) for causing imaging unit 200 to move between a plurality of positions in a direction parallel to the axis of rotation 256 of photoconductive drum 255.

Figure 12:
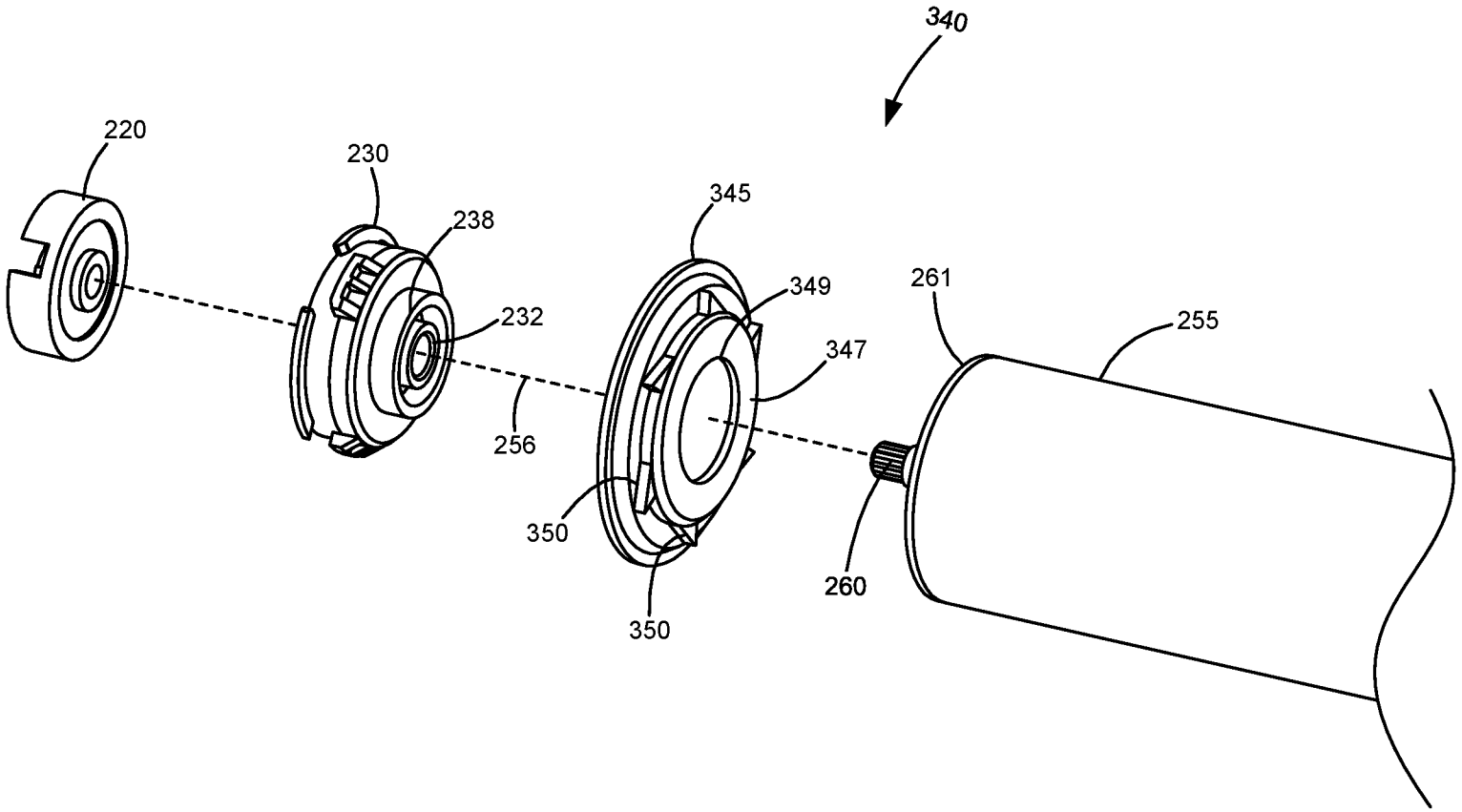
FIG. 12 is an exploded view of the ratchet mechanism shown in FIG. 11.

FIG. 12 illustrates an exploded view of ratchet mechanism 340. As shown, cam 345 is positioned between an axial end 261 of photoconductive drum 255 and bushing 230. Bushing 230 includes a rear journal portion 238 that passes through an opening 349 provided in cam 345 to rotatably secure cam 345 in imaging unit 200. Cam 345 is rotatable relative to bushing 230 and has a rotational axis that is coaxial with the axis of rotation 256 of photoconductive drum 255. Cam 345 may be retained on side wall 206*a* by retainers or hook features (not shown) provided in side wall 206*a*. Shaft end 260 of photoconductive drum 255 passes through cam 345 and bushing 230 via openings 232, 349 and is received by drive coupler 220 which is seated within socket 234 of bushing 230. Cam 345 is rotatable relative to housing 206 independent of drive coupler 220 and photoconductive drum 255. In the example embodiment illustrated, cam 345 is rotatable in a single direction. In other embodiments, cam 345 is rotatable in two directions.

Figure 13:
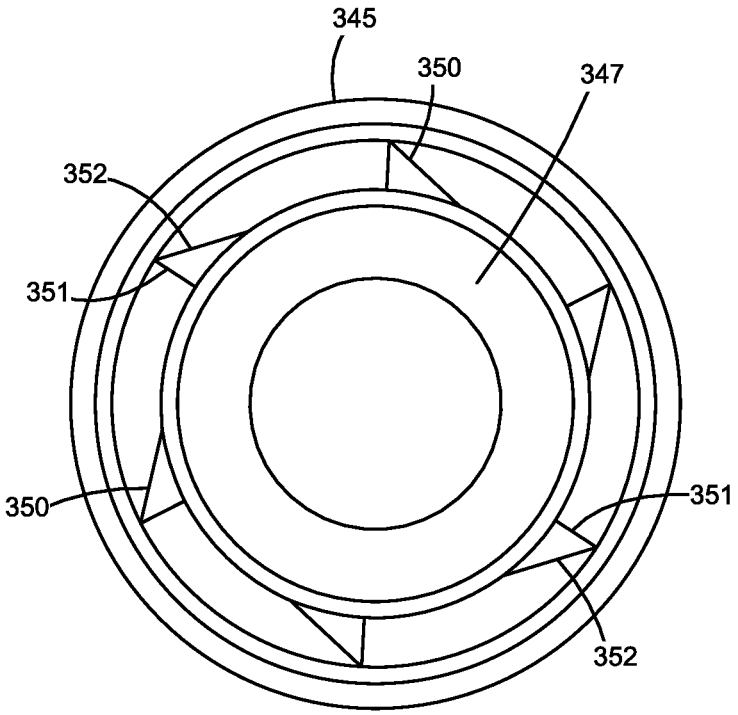
FIGS. 13 and 14 are front and side elevation views, respectively, of a cam of the ratchet mechanism shown in FIG. 12 according to one example embodiment.
Figure 14:
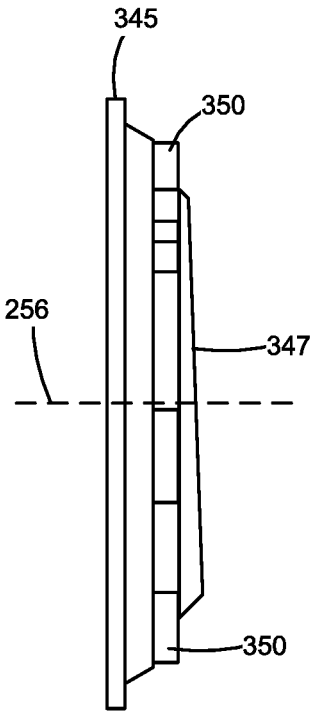
Figure 15:
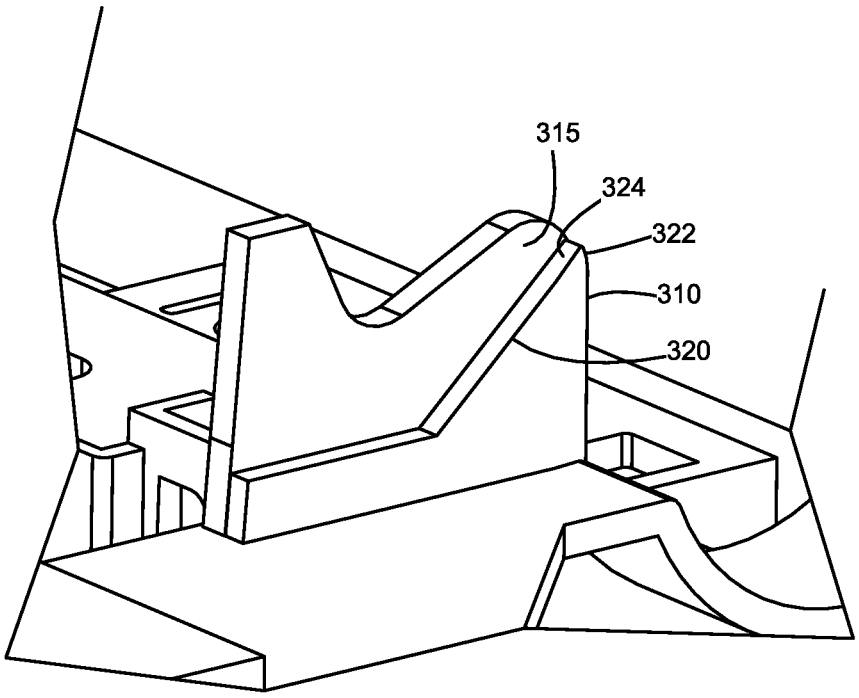
FIG. 15 is a perspective view of a datum member of the image forming device according to one example embodiment.

With reference to FIGS. 13-14, cam 345 includes a plurality of teeth 350 radially extending outward therefrom with each tooth 350 having an engaging surface 351 and a sliding surface 352. In the embodiment illustrated, each time imaging unit 200 is inserted into image forming device 22, one of the teeth 350 contacts datum member 310 to rotate cam 345 a predetermined amount. In FIG. 15, datum member 310 is shown including a locating surface 315 and a rail 320 projecting from locating surface 315 in the axial direction of photoconductive drum 255. Rail 320 generally has a triangular profile formed by an abutment surface 322 and a ramped surface 324. Abutment surface 322 is engageable by a tooth 350 of cam 345 during insertion of imaging unit 200 into image forming device 22 which causes cam 345 to rotate in one direction. On the other hand, ramped surface 324 allows imaging unit 200 to be removed from image forming device 22 without causing cam 345 to rotate.

Figure 16A:
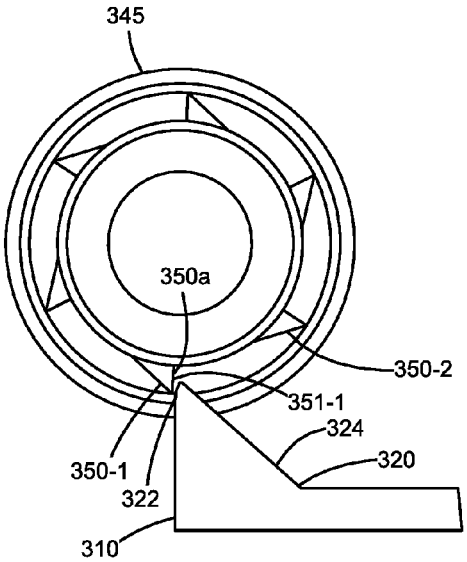
FIGS. 16A-16D are schematic illustrations of the operation between the cam and the datum member shown in FIGS. 11-15 according to one example embodiment.
Figure 16B:
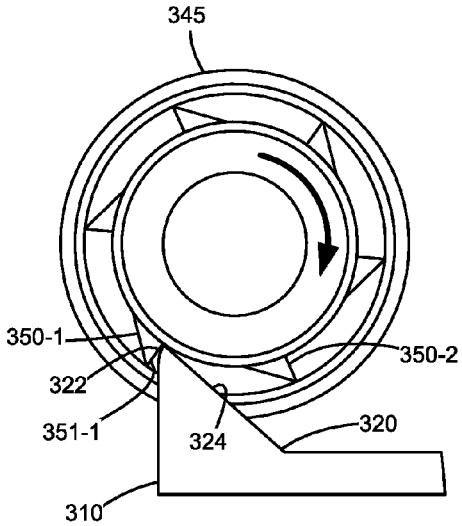
Figure 16C:
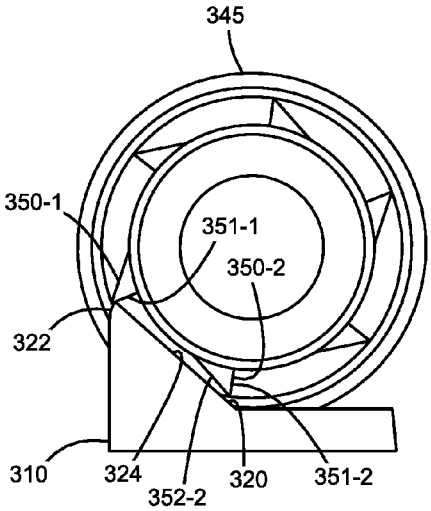
Figure 16D:
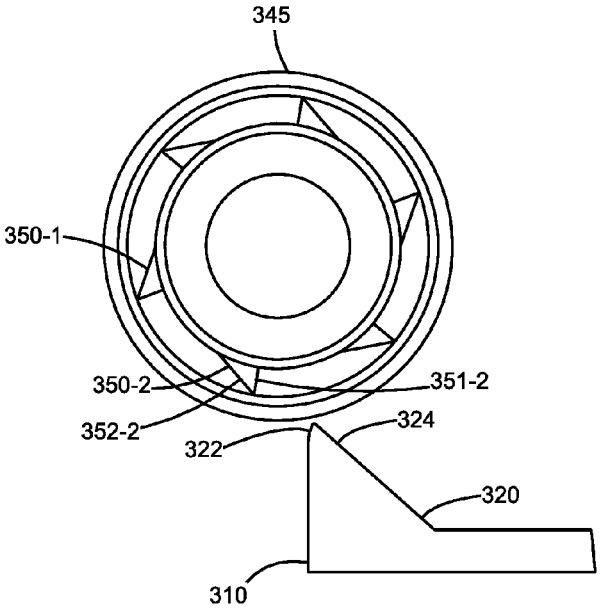

For example, FIGS. 16A-16D illustrate interaction between cam 345 and datum member 310 during insertion and removal of imaging unit 200 from image forming device 22. Locating surface 315 has been omitted to more clearly illustrate the operation between rail 320 and a tooth 350-1 of cam 345. FIG. 16A shows engaging surface 351-1 of tooth 350-1 contacting abutment surface 322 of datum member 310 as imaging unit 200 is inserted into image forming device 22. As imaging unit 200 is further advanced towards its final position in image forming device 22, contact between tooth 350-1 and abutment surface 322 urges cam 345 to rotate clockwise as viewed in FIG. 16B until imaging unit 200 reaches its final position within image forming device 22, shown in FIG. 16C. When imaging unit 200 is removed from image forming device 22, cam 345 maintains its rotational position as shown in FIG. 16D due to the position and angle of sliding surface 352-2 of tooth 350-2 relative to ramped surface 324. Sliding surface 352-2 of tooth 350-2 may or may not ride up ramped surface 324 upon removal of imaging unit 200 from image forming device 22. Upon reinsertion of imaging unit 200 into image forming device 22, the engaging surface 351-2 of tooth 350-2 contacts abutment surface 322 causing cam 345 to once again rotate clockwise as viewed in FIGS. 16A-16D. With each subsequent insertion of imaging unit 200 into image forming device 22, cam 345 is cycled to its next rotational position. In one example embodiment, the rotational position of cam 345 sets the axial position of photoconductive drum 255 relative to datum member 310 as described in greater detail below.

Figure 17A:
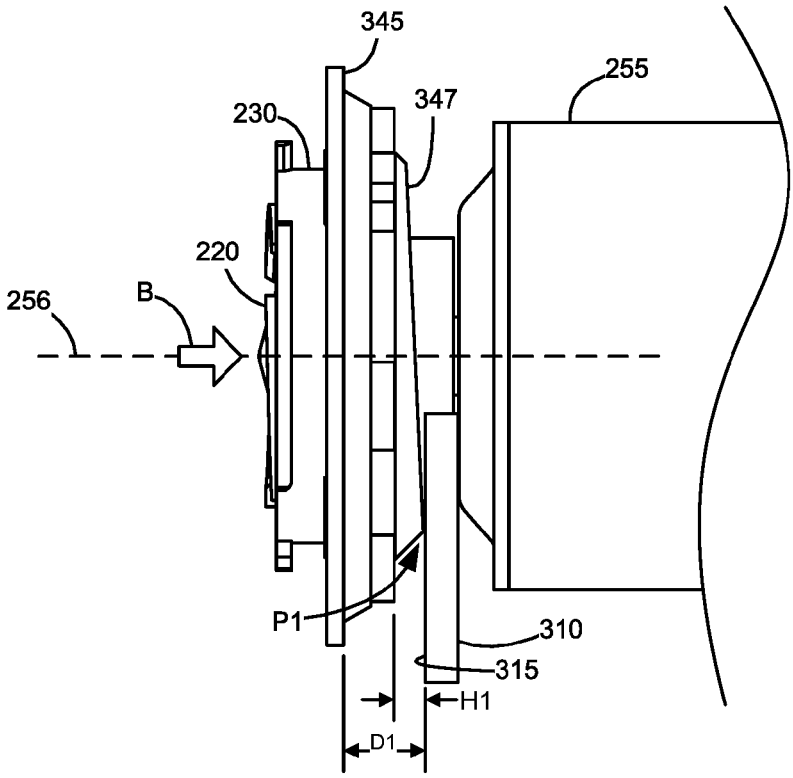
FIGS. 17A and 17B are side elevation views illustrating axial movement of the cam and the photoconductive drum relative to the datum member according to one example embodiment.
Figure 17B:
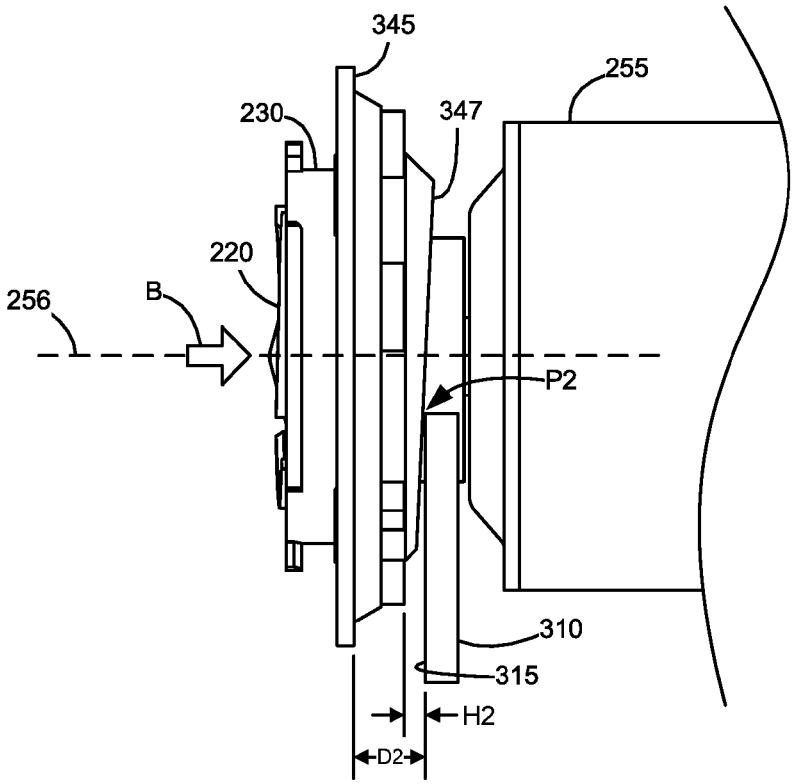

With reference back to FIG. 14, cam surface 347 has an uneven surface profile relative to an imaginary plane that is perpendicular to the axis of rotation 256 for contacting locating surface 315 of datum member 310. In the example shown, cam surface 347 has a substantially continuous tapered surface on an inner axial side of cam 345 such that cam surface 347 has a variable height in the axial bias direction B. However, it will be appreciated that cam surface 347 may have other forms or shapes that provide an uneven cam surface profile. For example, cam surface 347 may have discrete indexed surfaces or steps instead of being a continuous surface as shown. Cam surface 347 is positioned to abut locating surface 315 of datum member 310 such that changing the rotational position of cam surface 347 shifts the position of imaging unit 200 relative to datum member 310 along axis of rotation 256. For example, FIGS. 17A-17B illustrate interaction between cam surface 347 of cam 345 and locating surface 315 of datum member 310. Rail 320 of datum member 310 has been omitted in FIGS. 17A-17B to more clearly illustrate the positioning of cam surface 347 relative to locating surface 315.

In FIG. 17A, cam 345 is at a first rotational position in which a first point P1 of cam surface 347 contacts locating surface 315. In this first rotational position, cam 345 is displaced by a predetermined distance D1 from datum member 310 defined by the height H1 of first point P1 contacting locating surface 315. Displacement of cam 345 moves imaging unit 200 perpendicular to the media feed direction MFD thereby axially shifting photoconductive drum 255. In FIG. 17B, cam 345 is at a second rotational position whereby cam 345 has been rotated 180° relative to the first rotational position shown in FIG. 17A. In this second rotational position, a second point P2 of cam surface 347, which has a height H2 less than the height H1 of first point P1, contacts locating surface 315 causing cam 345 to be displaced by a predetermined distance D2 from datum member 310 that is less than distance D1. Accordingly, as the rotational position of cam 345 changes relative to datum member 310, a point of contact between cam surface 347 and locating surface 315 changes such that the distance from cam 345 to datum member 310 changes as the rotational position of cam 345 changes as defined by the height of the region of cam surface 347 contacting locating surface 315. In this manner, rotation of cam 345 moves imaging unit 200 perpendicular to the media feed direction MFD thereby axially shifting photoconductive drum 255.

Each tooth 350 of cam 345 provides a corresponding rotational position of cam 345. In the example illustrated, cam 345 includes six teeth 350 such that when imaging unit 200 is inserted into image forming device 22, one of the teeth 350 of cam 345 contacts the abutment surface 322 of rail 320 and causes cam 345 to rotate 60°. The uneven profile of cam surface 347 changes the axial position of photoconductive drum 255 each time imaging unit 200 is inserted into image forming device 22. Since each tooth 350 of cam 345 provides a corresponding rotational position of cam 345, each tooth 350 defines an extent of travel by photoconductive drum 255 in the axial direction. When, for example, imaging unit 200 is removed from image forming device 22 and thereafter reinserted, the axial position of photoconductive drum 255 is adjusted accordingly as a result of cam 345 undergoing rotational movement in response to contact between datum member 310 and a tooth 350 of cam 345. While the illustrated example embodiment shows cam 345 having six teeth 350, it will be appreciated that cam 345 may include any number of teeth to define a plurality of axial positions for photoconductive drum 255. It will also be appreciated that each tooth 350 of cam 345 may provide a unique axial position of photoconductive drum 255 relative to all other teeth 350 or some teeth 350 of cam to 345 may provide the same axial position of photoconductive drum 255. Further, the amount of shifting of photoconductive drum 255 for each rotational position may be adjusted by modifying the profile of cam surface 347 as desired.

Although the example embodiment illustrates rotation of cam 345 upon insertion of imaging unit 200 into image forming device 22, rotation of cam 345 may be triggered by any suitable means. For example, cam 345 may be rotated upon the removal of imaging unit 200 from image forming device 22 or upon the insertion of toner cartridge 100 into image forming device 22. In another embodiment, cam 345 is rotated upon the closing of a door in image forming device 22 that permits access to imaging unit 200. For example, a plunger or other projection extending from an internal portion of the door may contact a tooth 350 of cam 345 (or another engagement member of cam 345) to rotate cam 345. In other embodiments, cam 345 is rotated at predetermined intervals by an electromechanical device, such as a solenoid or motor in image forming device 22. Although the example embodiment illustrated includes a rotatable cam 345, the cam may take other suitable paths of motion (e.g., translating) as desired.

In the above example embodiment, locating surface 315 is provided as part of the image forming device 22 in which imaging unit 200 is installed. In other embodiments, cam surface 347 contacts a fixed locating surface on housing 206 of imaging unit 200. In these embodiments, an engagement member, such as a feature similar to rail 320, is provided in image forming device 22 to contact and rotate cam 345 upon insertion of imaging unit 200 into image forming device 22. Drive coupler 120 axially biases cam 345 in the axial bias direction B such that cam surface 347 remains in contact with the locating surface on housing 206. As a rotational position of cam 345 changes relative to housing 206, cam 345 shifts in the axial direction of photoconductive drum 255 relative to housing 206 causing photoconductive drum 255 to shift in the axial direction relative to the locating surface on housing 206. In this way, photoconductive drum 255 is axially shifted without shifting the entire imaging unit 200 relative to image forming device 22.

Figure 18A:
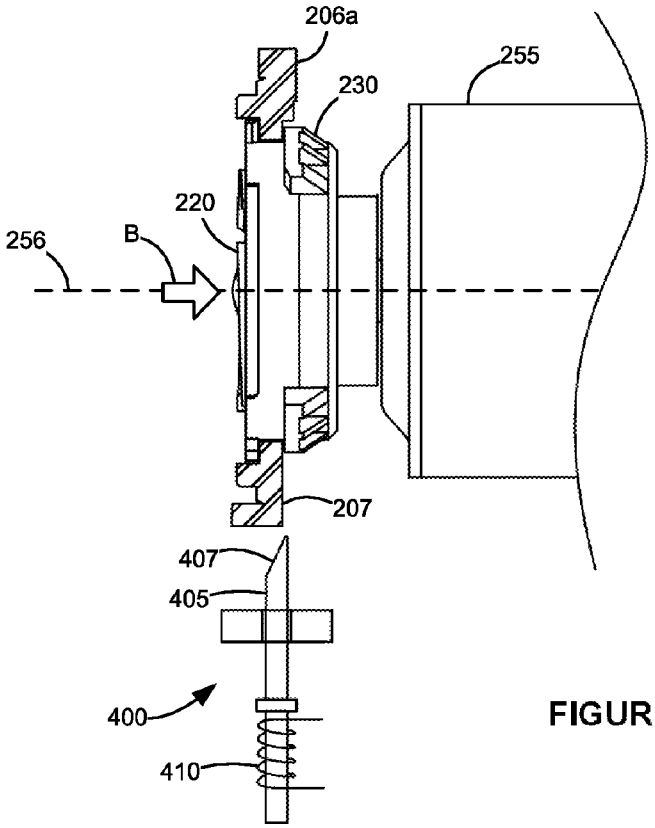
FIGS. 18A and 18B are schematic illustrations of an actuator of the image forming device that axially shifts the photoconductive drum according to one example embodiment.
Figure 18B:
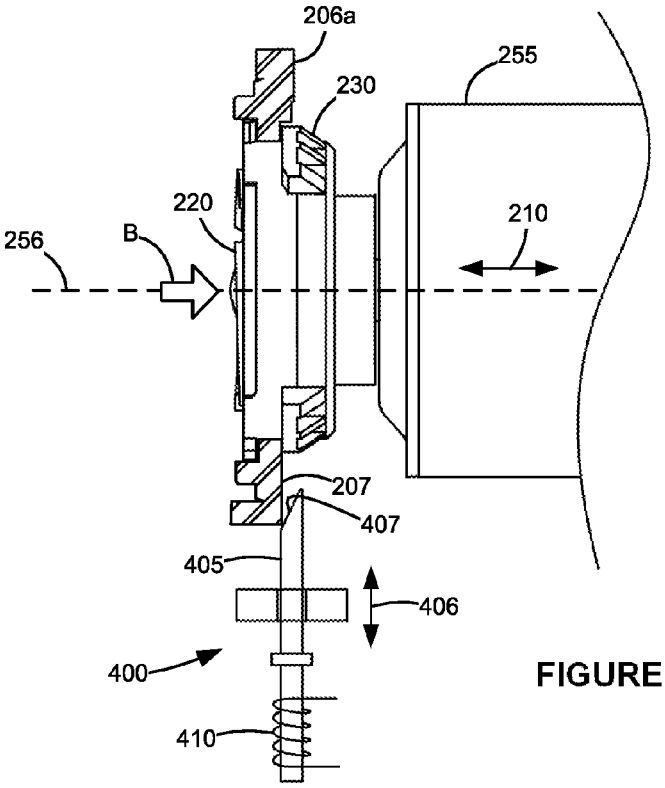

Referring now to FIGS. 18A-18B, another example embodiment of a system for axially shifting photoconductive drum 255 is illustrated. In this embodiment, image forming device 22 includes an actuator 400 that is operative to engage an exposed portion of imaging unit 200 to move imaging unit 200 along axis of rotation 256 and thereby shift an axial position of photoconductive drum 255 relative to its axis of rotation 256. For example, the exposed portion of imaging unit 200 may be a feature projecting from housing 206 or a portion of housing 206. In the example shown, actuator 400 includes a plunger 405 that is movable by a solenoid 410 to engage an exposed portion 207 of side wall 206*a*. It will be appreciated, however, that actuator 400 may take other suitable shapes or forms. Solenoid 410 is communicatively coupled to and activated by controller 28 to linearly move plunger 405 toward or away from exposed portion 207 as indicated by arrow 406. Plunger 405 has a tapered edge 407 that engages exposed portion 207 such that when exposed portion 207 of side wall 206*a* is in contact with tapered edge 407, linear motion of plunger 405 in the direction 406 is translated into reciprocating motion 210 of housing 206 along axis of rotation 256. For example, in FIG. 18A, plunger 405 is shown at an initial position prior to engaging exposed portion 207 of side wall 206*a*. As plunger 405 is moved toward and engages side wall 206*a*, the tapered edge 407 exerts an actuation force on side wall 206*a* against the biasing force of spring 125, causing imaging unit 200 to shift in a direction opposite the bias direction B as shown in FIG. 18B.

Photoconductive drum 255 may be shifted periodically by actuator 400 based on any desired condition or time interval. Photoconductive drum 255 may be axially shifted based on operating parameters and usage information related to image forming device 22 or imaging unit 200. For example, photoconductive drum 255 may be shifted based on the number of pages printed, the number of revolutions of photoconductive drum 255, etc. In this manner, photoconductive drum 255 may be shifted automatically without user intervention.

The configurations for actively shifting photoconductive drum 255 in the axial direction by an actuator mechanism of image forming device 22 are not limited to the example embodiments illustrated in FIGS. 18A-18B. Other configurations are possible. For example, actuator 400 may include a drive mechanism other than a solenoid, such as a motor. Further, an engagement member other than plunger 405 may be used as desired. For example, a solenoid or motor may move an indexing mechanism (such as cam 345 discussed above) or an engagement member that physically pushes or pulls imaging unit 200 a predetermined amount. In other embodiments, a shim may engage and disengage from between a portion of imaging unit 200 (e.g., bushing 230 or photoconductive drum 255) and a reference surface in image forming device 22 in order to shift the position of housing 206 within image forming device 22. While the example embodiment illustrated includes actuator 400 shifting the position of housing 206 within image forming device 22, other embodiments include actuator 400 shifting photoconductive drum 255 relative to housing 206. For example, actuator 400 may engage and disengage a shim from between bushing 230 and photoconductive drum 255 in order to shift photoconductive drum 255 relative to housing 206.

Accordingly, photoconductive drum 255 is shifted axially in order to distribute the wear on the surface of photoconductive drum 255 caused by the edges of the media sheet to help extend the useful life of photoconductive drum 255.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A photoconductor unit for an electrophotographic image forming device, comprising:

a housing;

a photoconductive drum rotatably mounted on the housing; and a cam mounted on the housing and having a cam surface that is positioned to contact a corresponding locating surface, the cam surface having a variable height in an axial direction of the photoconductive drum such that as a position of the cam changes relative to the housing, the photoconductive drum shifts in the axial direction relative to the locating surface, wherein the cam is positioned to contact a contact surface in the image forming device upon insertion of the photoconductor unit into the image forming device to change the position of the cam.

2. The photoconductor unit of claim 1, wherein the cam is rotatable and as a rotational position of the cam changes relative to the housing, the cam shifts in the axial direction of the photoconductive drum relative to the locating surface causing the photoconductive drum to shift in the axial direction relative to the locating surface.

3. The photoconductor unit of claim 2, wherein the cam is rotatable about an axis of rotation of the photoconductive drum.

4. The photoconductor unit of claim 1, wherein the cam and the photoconductive drum have a fixed relationship to one another in the axial direction of the photoconductive drum.

5. The photoconductor unit of claim 1, wherein as a position of the cam changes relative to the housing, the housing shifts in the axial direction of the photoconductive drum relative to the locating surface.

6. A photoconductor unit for an electrophotographic image forming device, comprising:

a housing;

a photoconductive drum rotatably mounted on the housing; and a cam mounted on the housing coaxial with the photoconductive drum and rotatable independent of the photoconductive drum, the cam and the photoconductive drum having a fixed relationship to one another in an axial direction of the photoconductive drum, the cam having a cam surface on an axial end of the cam that is positioned to contact a locating surface, the cam surface having a variable height in the axial direction of the photoconductive drum such that as a rotational position of the cam changes relative to the housing, the cam and the photoconductive drum shift in the axial direction of the photoconductive drum relative to the locating surface.

7. The photoconductor unit of claim 6, wherein the cam is positioned to contact a contact surface in the image forming device upon insertion of the photoconductor unit into the image forming device to rotate the cam.

8. The photoconductor unit of claim 6, wherein the cam includes a plurality of teeth radially extending outward therefrom that are positioned to contact a contact surface in the image forming device upon insertion of the photoconductor unit into the image forming device to rotate the cam.

9. The photoconductor unit of claim 8, wherein each tooth of the plurality of teeth sets a corresponding rotational position of the cam relative to the housing.

10. The photoconductor unit of claim 6, wherein as the rotational position of the cam changes relative to the housing, the housing shifts in the axial direction of the photoconductive drum relative to the locating surface.

11. An image transfer assembly of an electrophotographic image forming device, comprising:

a photoconductive drum rotatable about an axis of rotation within the image forming device;

a cam connected to the photoconductive drum and rotatable independent of the photoconductive drum, the cam having a cam surface that has a variable height in an axial direction of the photoconductive drum; and a locating surface in contact with the cam surface, wherein as a rotational position of the cam changes relative to the locating surface, the cam shifts in the axial direction of the photoconductive drum relative to the locating surface causing the photoconductive drum to shift in the axial direction relative to the locating surface, wherein the cam and the photoconductive drum have a fixed relationship to one another in the axial direction of the photoconductive drum.

12. The image transfer assembly of claim 11, further comprising a corresponding drive coupler of the image forming device operatively engaged with the drive coupler of the photoconductive drum to provide rotational and axial force to the drive coupler of the photoconductive drum for rotating and axially biasing the photoconductive drum in the axial direction of the photoconductive drum.

13. The image transfer assembly of claim 11, wherein the cam is rotatable about the axis of rotation of the photoconductive drum.

14. A photoconductor unit for an electrophotographic image forming device, comprising:

a housing;

a photoconductive drum rotatably mounted on the housing; and a cam mounted on the housing and having a cam surface that is positioned to contact a corresponding locating surface, the cam surface having a variable height in an axial direction of the photoconductive drum such that as a position of the cam changes relative to the housing, the photoconductive drum shifts in the axial direction relative to the locating surface, wherein the cam is rotatable and as a rotational position of the cam changes relative to the housing, the cam shifts in the axial direction of the photoconductive drum relative to the locating surface causing the photoconductive drum to shift in the axial direction relative to the locating surface, wherein the cam includes a plurality of teeth radially extending outward therefrom that are positioned to contact a contact surface in the image forming device upon insertion of the photoconductor unit into the image forming device to rotate the cam.

15. The photoconductor unit of claim 14, wherein each tooth of the plurality of teeth sets a corresponding rotational position of the cam relative to the housing.

* * * * *